US006394593B1

(12) United States Patent
Komplin et al.

(10) Patent No.: US 6,394,593 B1
(45) Date of Patent: May 28, 2002

(54) VENT SYSTEM FOR INK JET PEN HAVING INTERNAL PRESSURE REGULATOR

(75) Inventors: Steven Robert Komplin; James Harold Powers, both of Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 09/870,204

(22) Filed: May 30, 2001

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | | |
|---|---|---|---|---|
| 5,526,030 | A | 6/1996 | Baldwin et al. | 347/87 |
| 5,537,134 | A | 7/1996 | Baldwin et al. | 347/85 |
| 5,600,358 | A | 2/1997 | Baldwin et al. | 347/87 |
| 5,736,992 | A | 4/1998 | Pawlowski, Jr. | 347/7 |
| 5,777,647 | A | 7/1998 | Pawlowski, Jr. et al. | 347/86 |
| 5,841,454 | A | 11/1998 | Hall et al. | 347/87 |
| 5,844,577 | A | 12/1998 | Pawlowski, Jr. | 347/6 |
| 5,936,650 | A | 8/1999 | Ouchida et al. | 347/85 |
| 5,980,032 | A | 11/1999 | Pawlowski, Jr. et al. | 347/86 |
| 5,988,803 | A | 11/1999 | Komplin et al. | 347/86 |
| 6,019,459 | A | 2/2000 | Pew et al. | 347/85 |
| 6,033,064 | A | 3/2000 | Pawlowski, Jr. et al. | 347/87 |
| 6,120,138 | A | 9/2000 | Xiao et al. | 347/85 |
| 6,137,513 | A | 10/2000 | Pawlowski, Jr. et al. | 347/86 |

FOREIGN PATENT DOCUMENTS

| | | |
|---|---|---|
| JP | 09 156124 | 6/1997 |
| JP | 10 166606 | 6/1998 |
| JP | 11 105305 | 4/1999 |

*Primary Examiner*—Anh T. N. Vo
(74) *Attorney, Agent, or Firm*—David E. LaRose; Luedeka, Neely & Graham

(57) ABSTRACT

The invention relates to a vent system for an ink jet pen of the type having an internal pressure regulator. The vent system provides air flow communication between the exterior of the ink jet pen and an interior chamber associated with the pressure regulator while substantially inhibiting the flow of water vapor out of chamber to the exterior of the pen. The vent system includes an elongate flow path defined adjacent the exterior of the pen, the flow path having a first end in flow communication with the chamber and a second end in flow communication with the exterior of the pen.

18 Claims, 6 Drawing Sheets

VENT SYSTEM FOR INK JET PEN HAVING INTERNAL PRESSURE REGULATOR

FIELD OF THE INVENTION

The invention relates to an improved ink jet printhead and to a vent system for maintaining desirable environmental conditions within the printhead.

BACKGROUND

Ink jet printers typically include a print head having either heaters or piezoelectric devices for ejecting ink during printing. In either case, liquid ink is directed from a reservoir to a plurality of chambers, each associated with a heater or piezoelectric device and a nozzle. The heaters/piezoelectric devices are electronically controlled to eject ink in a desired sequence that corresponds to the image to be printed.

To provide desirable conditions for controlling the flow of ink from the reservoir to the chambers, the reservoir may initially be placed under a condition of a slight vacuum with respect to ambient pressure. The vacuum condition is commonly referred to as a "backpressure". In order to maintain a desired backpressure in the reservoir throughout the operating life of the printhead, a pressure regulating device may be included. The pressure regulating device is intended to help maintain a desired negative pressure in the reservoir and adjust against pressure changes in the reservoir resulting from, for example, increases or decreases in operating temperatures and pressures (e.g., hot, cold or altitude changes or pressure changes associated with air travel) and from pressure changes associated with a decrease of the volume of ink in the reservoir through use of the printhead.

One problem associated with pressure regulators is that the pressure regulators are often made from materials that are permeable to water vapor. Water evaporating from the ink tends to flow by diffusion to areas of lower relative humidity, in this case, the pressure regulator chamber. The relative humidity of the pressure regulator chamber is affected by air flow into the chamber from the atmosphere exterior to the ink reservoir as the volume of ink in the reservoir decreases. The flow of air affects the relative humidity of the chamber providing a relative humidity differential that induces water evaporation from the ink and net water vapor flow into the chamber.

Some printheads further include so-called "bubble generators." Bubble generators generally include a valved orifice that permits controlled flow communication of air between the interior and the exterior of the ink reservoir. Such bubble generators are generally designed to permit air to "bubble" into the reservoir to increase the pressure within the reservoir (i.e., reduce the vacuum). A problem attendant to bubble generators is leakage of ink to the exterior of the reservoir. Another problem is drying of ink in the reservoir adjacent the bubble generator which leads to dysfunction, causing undesirable reservoir environmental conditions and reduction in printhead operation and longevity.

The present invention relates to a vent system for use with ink jet pens of the type having internal pressure regulators. The vent system advantageously functions to maintain desirable environmental conditions within the ink jet pen for improved pen operation and longevity. In addition, for pens of the type having an internal pressure regulator in flow communication with the bubble generator, the vent system functions to inhibit ink leakage from the pen.

SUMMARY OF THE INVENTION

With regard to the above and other objects and advantages, the invention provides a vent system for an ink jet pen of the type having an internal pressure regulator. The vent system provides air flow communication between the exterior of the ink jet pen and an interior chamber associated with the pressure regulator while substantially inhibiting the flow of water vapor from the chamber to the exterior of the pen.

In a preferred embodiment, the invention provides an ink jet pen having an exterior portion and an interior portion, and a pressure regulator within the interior portion including a chamber associated therewith. The vent system is provided by an elongate air flow path defined adjacent the exterior of the pen, the flow path having a first end in flow communication with the chamber of the internal pressure regulator and a second end in flow communication with the exterior of the pen. It is particularly preferred that the vent system be configured to substantially inhibit water vapor flow to the exterior of the pen from the chamber of the pressure regulator.

In another aspect the invention provides an ink cartridge for an ink jet printer. The cartridge includes a body portion including a first panel portion having an interior surface opposite an exterior surface, a second panel portion attachable to the body portion to define a cavity for containing ink between the first panel portion and the second panel portion, and a chamber defined within the cavity adjacent the interior surface of the body portion. A lung type pressure regulator is disposed within the cavity adjacent the chamber. An air diffusion path provides flow communication between the exterior surface of the body portion and the chamber. The air diffusion path includes an elongate flow path defined adjacent the exterior surface of the body portion, the flow path having a first end in flow communication with the chamber and a second end in flow communication with the exterior surface of the body portion, whereby flow of water vapor out of the chamber is significantly inhibited.

As described in more detail below, the vent system advantageously helps to maintain a desirable climate within chamber of the pressure regulator so that water evaporation from the ink is inhibited. In particular, the vent system is configured to maintain a relatively humid environment within the chamber associated with the pressure regulator while permitting air flow into and out of the chamber. By maintaining the humidity of the chamber above a desired value, water vapor permeation through the lung material from the ink is minimized. Hence the water content of the ink in the pen over time remains relatively constant. Loss of water from the ink is detrimental to the operation of the pen. In addition, when incorporated in ink jet pens of the type having a bubble generator in flow communication with the chamber of the pressure regulator, the vent system functions to reduce the incidence of ink leakage to the exterior of the pen.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE PREFERRED EMBODIMENTS

The invention relates to a vent system 4 for use with an ink jet pen 6 of the type having an internal pressure regulator 8. The vent system 4 advantageously functions to inhibit ink leakage from the pen 6 and to maintain desirable environmental conditions within the ink jet pen for improved pen operation and longevity.

The pen 6 with which the vent system 4 is used preferably includes a lung-type internal pressure regulator 8. The preferred configuration for the basic construction of a pen 6 having an internal pressure regulator 8 for use with the vent system 4 of the present invention is described in U.S. Pat. No. 6,168,267, issued on Jan. 2, 2001 Komplin and entitled "PRESSURE CONTROLLED INK CARTRIDGE" (Assigned to Lexmark International, Inc.), the disclosure of which is incorporated herein by reference in its entirety.

Figure 1:
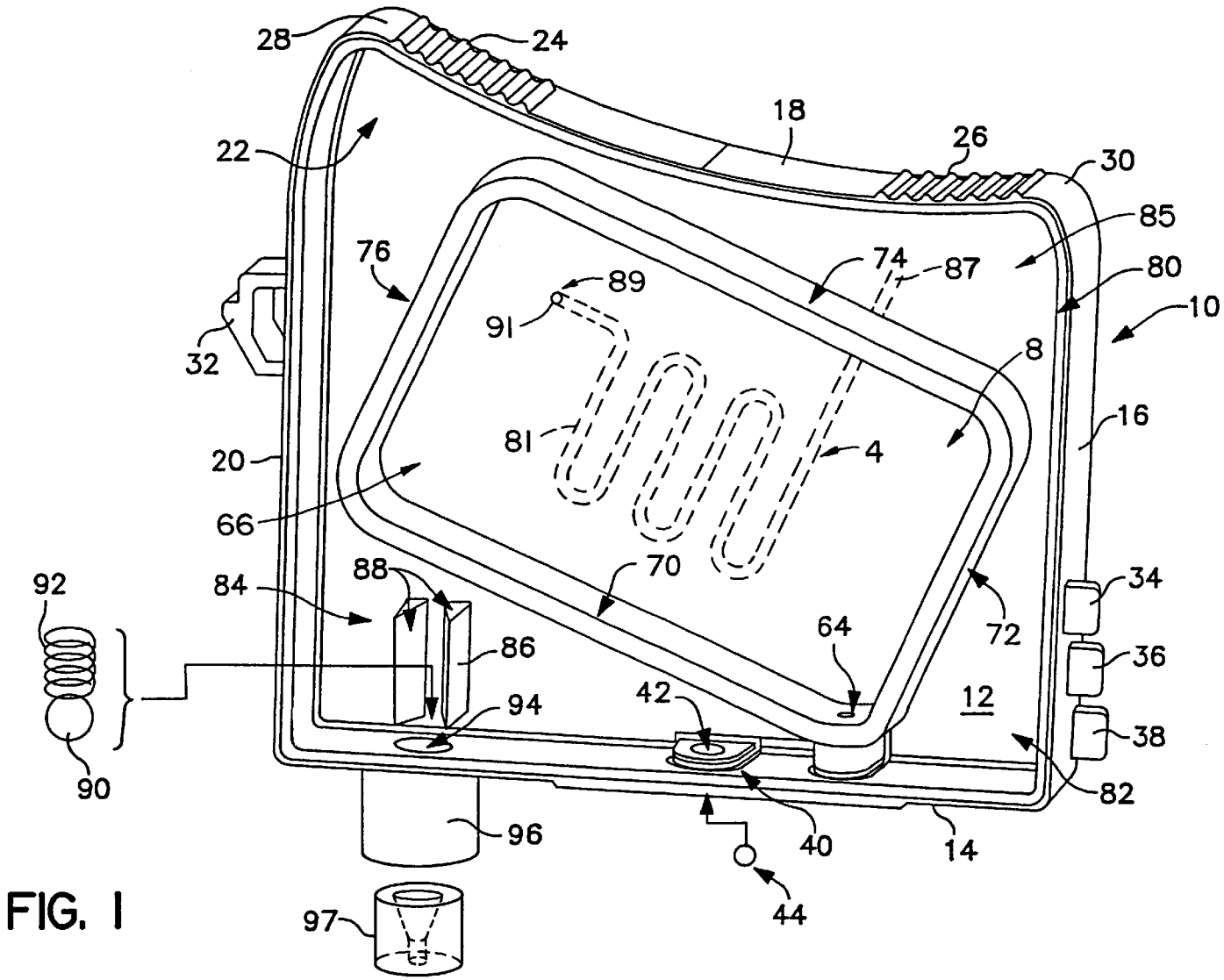
FIG. 1 is an inside perspective view of a first portion of an ink cartridge body of a printhead into which the vent system of the present invention may be incorporated.
Figure 2:
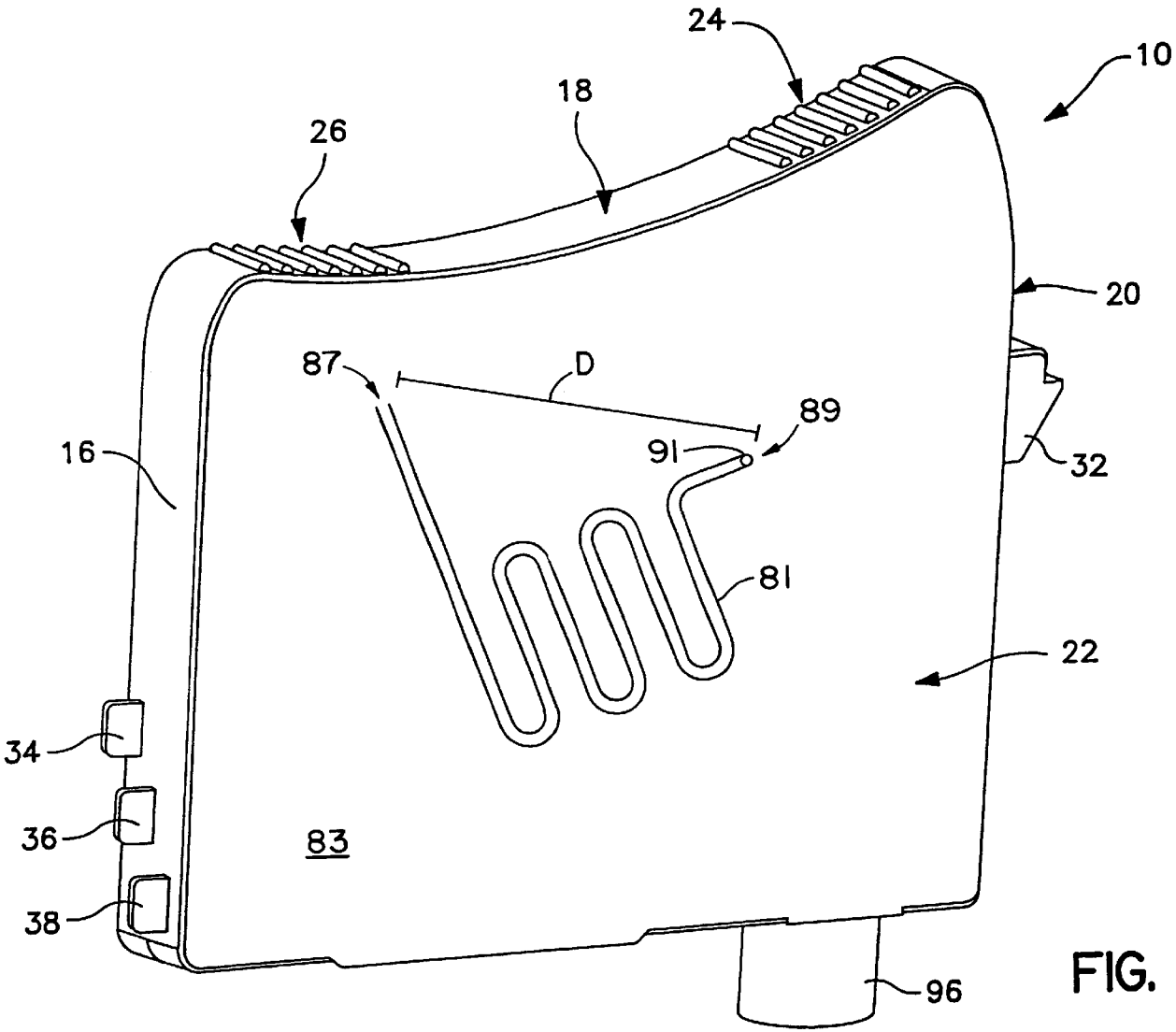
FIGS. 2 and 2*a* are outside perspective views of the ink cartridge body portion of FIG. 1.
Figure 3:
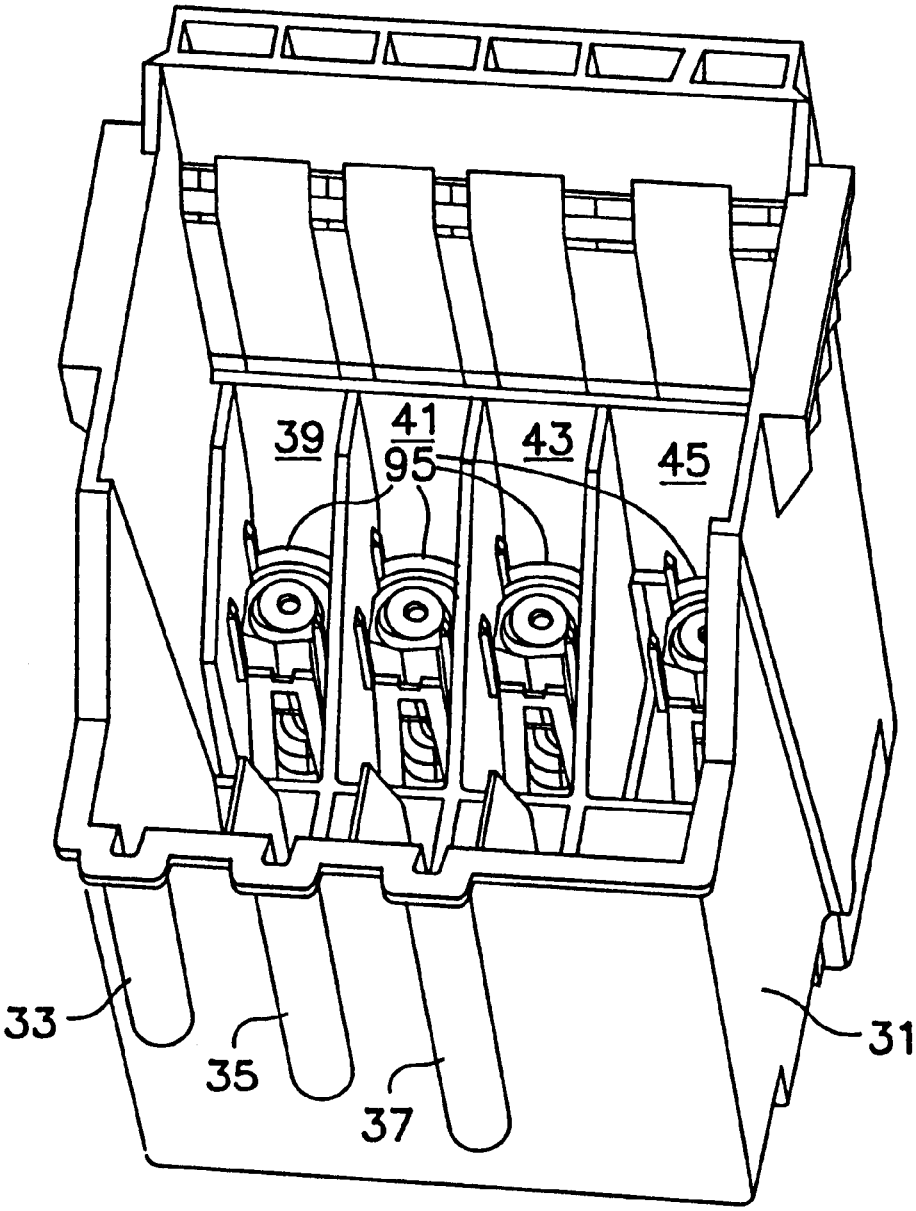
FIG. 3 is a top perspective view of a printhead body for use with a printhead made using the ink cartridge body portion of FIG. 1.

Accordingly, and with initial reference to FIGS. 1 and 2, the pen 6 preferably includes a substantially rectangular ink cartridge body 10 containing an interior cavity 12 for containing ink. The body 10 has first, second, third and fourth side walls 14, 16, 18 and 20 defining the perimeter of cavity 12. The side walls 14–20 are each attached to a first side panel portion 22. Side wall 18 may contain a handle or preferably contains ridges 24 and 26 which are disposed toward opposite ends 28 and 30 of side wall 18 for use in inserting and removing ink cartridge body 10 from a printhead body 31 (FIG. 3). Side wall 18 is preferably arc-shaped so that side wall 20 has a length greater than side wall 16. Side wall 20 also preferably contains a latch 32 for attaching the ink cartridge body 10 to a printhead body 31 of an ink jet printer.

Side wall 16 of the cartridge body 10 preferably contains a plurality of staggered tabs such as tabs 34, 36 and 38 which may be removed to provide identification of the ink cartridge with respect to its proper location in a printhead body 31. The tabs 34, 36 or 38 may be removed as by cutting or breaking the tabs from side wall 16 to define an ink cartridge containing tab 34, tab 36 or tab 38 which is made to correspond to keying channels 33, 35 or 37 of cartridge slots 39, 41 or 43 of the printhead body 31 (FIG. 3). A wider cartridge body similar to cartridge body 10, preferably containing no removable tabs, is insertable in cartridge slot 45 of the printhead body 31.

Referring again to FIG. 1, a bubble generator 40 which includes an aperture 42 and a ball 44 is preferably disposed in the first side wall 14 of the rectangular cartridge body 10. The aperture 42 of the bubble generator 40 is in fluid flow communication with the interior cavity 12 of the body 10. Aperture 42 provides an orifice for the bubble generator 40.

After the cavity 12 is filled with ink, a reduced pressure or back pressure is applied to the cavity 12, preferably through an ink feed port 94, described below, to provide a predetermined pressure differential between cavity 12 and an ink jet printhead. As ink is ejected by a printhead, the volume of ink in cavity 12 decreases. A pressure regulator 98, preferably a lung, which is described in more detail below with reference to FIGS. 5 and 6 serves to maintain a predetermined pressure in cavity 12 as the volume of ink in the cavity decreases. The pressure regulator 98 also helps to compensate for pressure changes in ink cavity 12 due to temperature, ambient pressure in the printer or cartridge environment and the like.

In order to maintain the pressure in the ink cavity 12 above a predetermined minimum pressure, the bubble generator 40 is selected to induce gas flow into cavity 12 while preventing flow of ink out of cavity 12. The gas flow bubbles entering the cavity 12 flow through the ink and accumulate in an upper portion of cavity 12 above the ink level. In this way, the pressure in cavity 12 is maintained above a predetermined minimum pressure. In most applications, the predetermined minimum pressure or back pressure ranges from about −12 to about −24 centimeters (cm) of water.

The ball 44 inserted in aperture 42 has a diameter ranging from about 1 to about 5 millimeters, preferably about 3 millimeters and is preferably made of a corrosion resistant material compatible with the ink in the ink cartridge body 10. Such corrosion resistant materials include but are not limited to glass, ceramic, stainless steel, fluorocarbon polymers and the like. The most preferred material is stainless steel.

The pressure regulator 8 is preferably a lung-type regulator 98 having a lung chamber 66 defined by lung frame walls 70, 72, 74 and 76 and a portion of first side panel 22 lying within the area defined by lung frame walls 70, 72, 74 and 76. At least one of the lung frame walls preferably has a surface, such as the surface of lung frame wall 70 adjacent the bubble generator 40 which promotes gas bubble formation in the interior cavity 12 (FIG. 1). Lung frame wall 70 is preferably angled with respect to an axis parallel with cartridge side wall 14 thereby providing increasingly greater spacing between lung frame wall 70 and cartridge side wall 14 proceeding from cartridge side wall 16 to cartridge side wall 20.

A number of advantages are provided by use of a lung structure possessing angled lung frame wall 70. One advantage is that because frame wall 70 is not closely adjacent aperture 42, there is less inhibition of bubble formation as gas flows into cavity 12 through aperture 42 of bubble generator 40. Less inhibition of bubble formation results in a greater range of pressure control in cavity 12.

Figure 4:
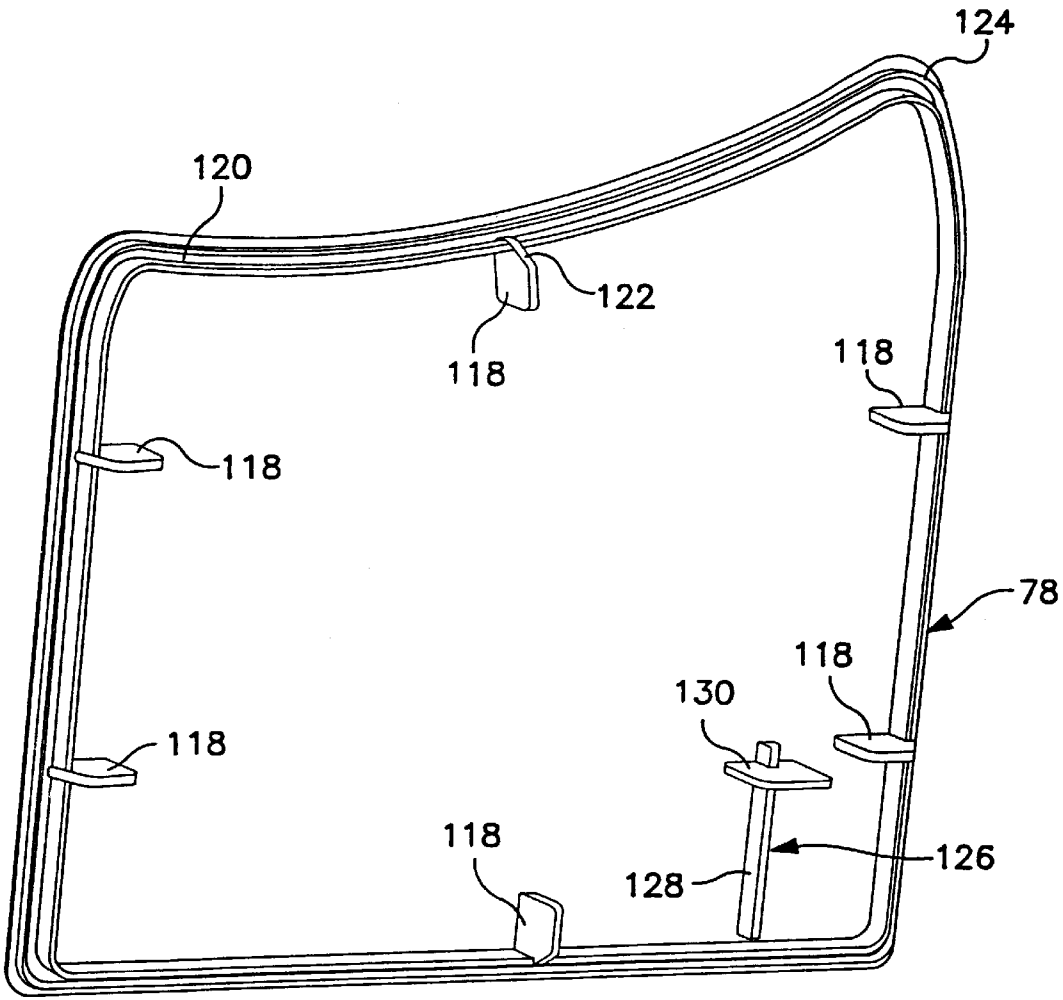
FIG. 4 is an inside perspective view of a second portion of an ink cartridge body that is combinable with the first portion of FIG. 1.

Another advantage is that there is more room between lung frame walls 70, 72, 74 and 76 and cartridge side walls 14, 16, 18 and 20 for tooling used to form cartridge side walls 14, 16, 18 and 20 and lung frame walls 70, 72, 74 and 76. The increased tooling room provides an increased cooling rate of the cavity side of side walls 14, 16, 18 and 20 which in turn reduces the warpage of cartridge side walls 14, 16, 18 and 20 caused by unequal cooling through the thickness of the wall material. Reducing the warpage of side walls 14, 16, 18 and 20 increases the ability to form gas and liquid tight seals between second side panel 78 (FIG. 4) and the welding ledge 80 around the periphery of the cartridge body 10 defined by the edges of cartridge side walls 14, 16, 18 and 20.

The sloping configuration of lung frame wall 70 also functions to direct ink or other liquids which may have flowed into lung chamber 66 toward aperture 64 thereby improving the drainage rate of liquids or ink from chamber 66. It is thus preferred to locate aperture 64 in an apexial area of chamber 66 defined by the intersection of frame walls 70 and 72 as shown in FIG. 1.

Another advantage of the sloped or angled orientation of lung frame wall 70 is the provision of areas 84 and 82 between cartridge side walls 14 and 16 and lung frame walls 70 and 72 respectively. Area 84 preferably has dimensions sufficient to provide for a ball check valve support structure 86 for a ball check valve device. Support structure 86 preferably includes rounded edges 88 and is adapted to guide a ball valve 90 and an urging device for ball valve 90 such as spring 92 in a linear direction through aperture 94 toward and away from boss 96 containing an elastomeric septum 97 upon removal and insertion of an ink supply needle of a needle valve assembly 95 (FIG. 3) through boss 96, septum 97 and associated aperture 94. Septum 97 used for sealing boss 96 includes a septum made from a variety of natural and synthetic rubber materials. During use, an ink supply needle contacts ball valve 90 causing ball valve 90 to recede from septum 97 thereby enabling ink to flow from cavity 12 through the needle to a corresponding printhead on the printhead body 31 (FIG. 3). Upon removal of a needle from boss 96, ball valve 90 is urged by spring 92 toward septum 97 so that ball valve 90 again seals against the septum 97 to prevent flow of ink therethrough when the cartridge body 10 is not attached to a printhead body 31.

The ball valve 90 and spring 92 are preferably constructed of ink resistant materials. Such materials include but are not limited to glass, ceramic, fluorocarbon polymers and metals. A particularly preferred material for ball valve 90 and spring 92 is stainless steel.

Returning to FIG. 1, area 82 in cavity 12 provides a suitable location for a level sensor for detecting the amount of ink remaining in ink cavity 12. If lung frame wall 72 were substantially parallel to cartridge side wall 16, the distance between frame wall 72 and cartridge side wall 16 would not be sufficient for many of the ink level sensing devices commonly used with ink cartridges such as magnetic level sensors, photo-reflective level sensors, ultrasonic level sensors, float-type level sensors and the like.

While the above advantages of an angled lung frame wall 70 have been described generally with respect to substantially rectangular lung chamber 66, similar results may be obtained with lung frame walls which is substantially circular, oval, triangular or other polygonal shape providing there is increasingly greater spacing between frame wall 70 and cartridge side wall 14 when moving from cartridge side wall 16 to cartridge side wall 20.

Returning to FIG. 2, there is shown the body 10 having a serpentine groove or channel 81 on an exterior surface 83 of side panel 22 thereof opposite an interior surface 85 of the ink cartridge 10. The channel 81 is continuous between opposite ends 87 and 89, with an aperture 91 located adjacent end 89 extending between the surfaces 83 and 85. The channel 81 is preferably formed during molding of the body 10.

The channel 81 preferably has a length of from about 10 mm to about 600 mm and a substantially uniform cross-sectional area defining a conduit having a cross-sectional area of from about 0.2 $mm^2$ to about 2.0 $mm^2$. The aperture 91 is preferably circular, with a radius corresponding to that of the channel. The channel 81 may be straight, serpentine or other labyrinth shape, provided the ratio of the channel overall length (L) to its cross-sectional area (CA) for flow ranges from about 20 $mm^{-1}$ (L) to about 6000 $mm^{-1}$ (L/CA). The channel 81 is preferably substantially centrally located on the surface 83, with the aperture 91 being located within the boundaries of the lung frame walls 70–76 so that the aperture 91 is located adjacent the lung frame wall 72.

Figure 2A:
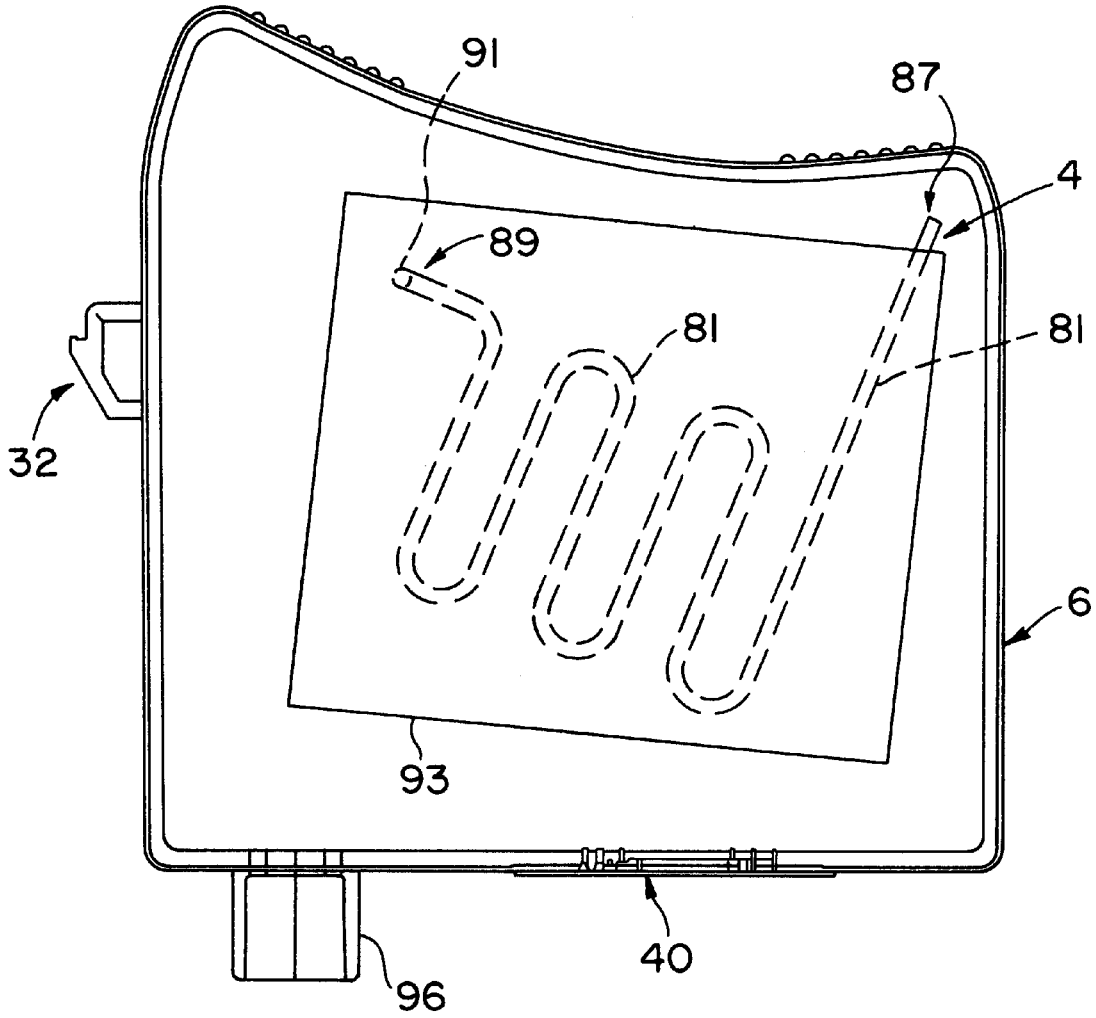

With reference now to FIG. 2*a*, a substantially vapor and liquid impermeable cover, preferably a flexible plastic material sheet, such as adhesive strip 93 is adhesively secured to the surface 83 to cover substantially all of the channel 81, except for a portion adjacent the end 87. As will be appreciated, the material 93 defines a boundary for the channel 81 to provide an enclosed flow path or conduit extending from the aperture 91 to the end 87 for travel of air and inhibition of water vapor diffusion therein. The term "substantially vapor impermeable" means that the transmission of water vapor through the cover 93 is substantially less than the diffusion of water vapor out of end 87 of the conduit 81 to the atmosphere.

For ink jet pens having a bubble generator in flow communication with the internal pressure regulator, such as the bubble generator 40 being linked to the chamber 66 by the vent 64, the vent system 4 advantageously inhibits leakage of ink to the exterior of the pen. For example, it will be appreciated that ink leaking from the cavity 12 through the bubble generator 40 flows into the lung chamber 66 via the vent 64. In order for this leaked ink to exit to the exterior of the pen 6, it must then exit the chamber 66 via the aperture 91 and travel the length of the conduit provided by the channel 81/cover 93.

Figure 5:
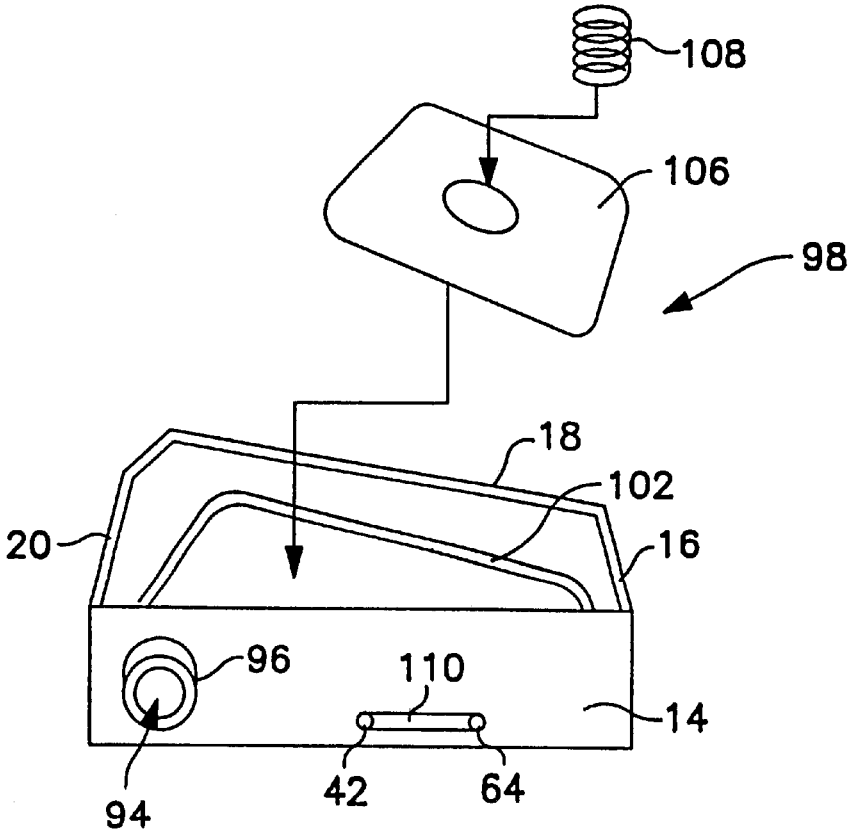
FIG. 5 is a perspective view of a lung-type pressure regulator incorporated into the first body portion of FIG. 1.
Figure 6:
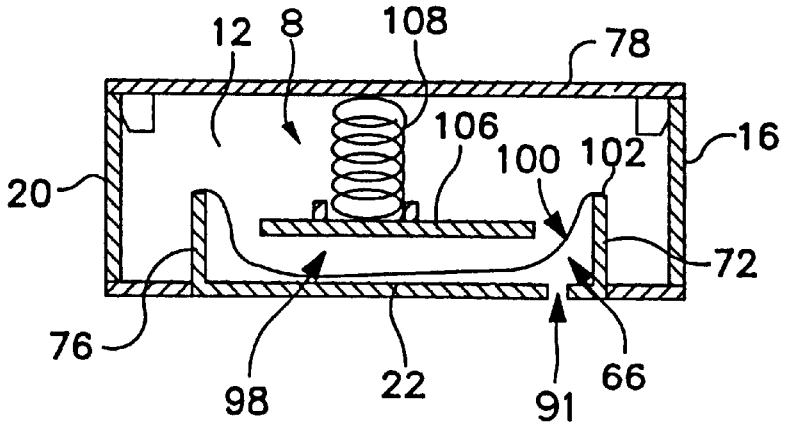
FIG. 6 is a cross-sectional view of a printhead having a lung-type pressure regulator and incorporating a vent system in accordance with the invention.

With reference to FIGS. 5 and 6, the lung 98 preferably includes lung chamber 66 defined by lung frame walls 70, 72, 74 and 76 (FIG. 1) and a portion of first side panel 22 lying with the area defined by frame walls 70, 72, 74 and 76. A resilient flexible polymeric material 100 is attached to the peripheral edge 102 defined by frame walls 70, 72, 74 and 76. The flexible polymeric material 100 may be selected from films that are compatible with the material used for forming the ink cartridge body 10 and inks used in the ink cartridge and films adaptable to welding or adhesive attachment thereof to the lung frame walls 70, 72, 74 and 76. A particularly preferred flexible polymeric material 100 a copolymer polypropylene material available from Triangle Plastics of Raleigh, N.C. under the trade name CPP40. The flexible polymeric material 100 is permeable to water vapor and therefore enables water evaporated from the ink in cavity 12 to flow into chamber 66.

The conduit provided by the channel 81/sheet 93 enables air flow communication between the chamber 66 and the external atmosphere while substantially inhibiting the diffusion of water vapor in the channel 81 between the chamber 66 and the exterior of the pen. This feature has been observed to beneficially provide an environment within the chamber 66 that is of relatively high humidity (e.g., from about 60% relative humidity (RH) to about 100% RH). Maintenance of such desirable humidity reduces the pressure difference driving vapor permeation through the polymeric material 100 and reduces the partial pressures of the dry gas constituents of air (predominantly nitrogen and oxygen), so as to reduce the partial pressure differences, which affect air permeation through the polymeric material 100. This is beneficial to extend the shelf and service life of the pen 6 and also of pens not having the bubble generator linked to the internal pressure regulator.

After heat attaching the polymeric material 100 to frame walls 70, 72, 74 and 76, the material 100 is heated while applying a reduced pressure to lung chamber 66 by means of vent hole 64 or aperture 91 thereby causing material 100 to closely conform to lung chamber 66. Heating the material 100 while applying reduced pressure to lung chamber 66 has been found to reduce wrinkles and improve the pressure response of pressure regulator 98. Prior to filling cavity 12 with ink, a piston member 106 and urging member 108 are inserted in cavity 12 within the perimeter of frame walls 70, 72, 74 and 76 for urging polymeric material 100 toward first side panel portion 22. A second side panel 78 is then attached to the first, second, third and fourth side walls 14, 16, 18 and 20 of the cartridge body 10. A ball 44 is inserted in the aperture 42 of the bubble generator 40 (FIG. 1) and a film is applied over channel 110 and aperture 64 to seal the aperture 64 and channel 110 connecting apertures 42 and 64. The cavity 12 is then filled with ink and a reduced pressure is applied to cavity 12.

Despite the use of an angled pressure regulator 98 in cavity 12, side walls 14, 16, 18 and 20 (FIG. 1) may still be slightly warped or bowed as a result of the injection molding process used to form cartridge 10. In order to counteract the tendency for side walls 14, 16, 18 and 20 to bow or warp, second side panel 78 is adapted to contain urging members 118 (FIG. 4) which are preferably disposed in predetermined locations on second side panel 78. Urging members 118 are preferably upstanding, substantially rectangular tabs containing a chamfered edge such as edge 122 which assists in urging side walls 14, 16, 18 and 20 outwardly so to maintain the planarity of side walls 14, 16, 18 and 20 to reduce the inward bowing of the side walls for sealably welding weld projection 124 to the welding ledge 80 of cartridge body 10 (FIG. 1). Five urging members 118 are shown on side panel 78, however, side panel 78 may contain more or fewer urging members 118 as the need arises and depending on the length of side walls 14, 16, 18 and 20 of body 10.

Another feature of second side panel 78 is raised wall 120 which is disposed inward of weld projection 124 and provides protection for the weld projection 124 against damage during handling of the second side panel 78. Protection of weld projection 124 is desirable because the weld projection 124 is relatively flimsy and may be easily damaged if bumped or otherwise struck with a foreign object. The weld projection 124 provides a site for ultrasonically welding second panel 78 to the welding ledge 80 of body 10. In the alternative, an adhesive may be applied to ledge 80 or to the second side panel 78 in the absence of weld projection 124 to adhesively attach the side panel 78 to the cartridge body 10. Welding or adhesives are required to provide a liquid and gas tight seal between body 10 and panel 78 so as to avoid ink leakage, evaporation of liquid ink components and/or undesired pressure changes within cavity 12.

Another aspect of side panel 78 is guiding member 126 which includes a guide bar 128 and a stop member 130. Guide bar 128 is positioned to be spaced between the two portions of support structure 86 (FIG. 1) so as to retain ball valve 90 and spring 92 between guide bar 128 and rounded edges 88 of support structure 86. Stop member 130 provides a retainer for spring 92 so that spring 92 can exert urging resistance on ball valve 90 thereby sealing orifice 94 when the cartridge body 10 is not attached to a printhead body 31.

With respect to the cartridge body 10 and second panel 78, all of the features described above, with the exception of the ball 44, ball valve 90, spring 92, flexible polymeric material 100, piston member 106 and urging member 108 are molded into the cartridge body 10 and side panel 78. Accordingly, body 10 and side panel 78 are preferably molded from materials selected from the group of thermoplastic materials including but not limited to polyphenylene oxide/polystyrene alloys, polypropylene, acrylonitrile/butadiene/styrene terpolymers, polystyrene/butadiene alloys or copolymers, polyetherimide, polysulfone, polyesters and the like. A particularly preferred material for body 10 and panel 78 a polypropylene material having a melt flow rate of about 12 grams per 10 minutes according to ASTM D-1238 and a density of about 0.9 grams/cm$^3$ according to ASTM D-1505 available from Huntsman Polypropylene Corporation of Woodbury, N.J. under the trade name P4G4B-036.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. An ink cartridge for an ink jet printer, the cartridge comprising a body portion including a first panel portion having an interior surface opposite an exterior surface exposed to an atmosphere having an atmospheric pressure, a second panel portion attachable to the body portion to define a cavity for containing ink between the first panel portion and the second panel portion, and a chamber defined within the cavity adjacent the interior surface of the first panel portion of the body portion, a lung type pressure regulator disposed within the cavity adjacent the chamber, and an air diffusion path for providing flow communication between the chamber and the atmosphere, the air diffusion path comprising an elongate flow path defined on the first panel portion of the body portion, the flow path having a first end in flow communication with the chamber and a second end located on the exterior surface of the first panel portion of the body and in flow communication with the atmosphere, whereby the flow path enables air flow communication between the chamber and the atmosphere while substantially inhibiting flow of water vapor out of the chamber.

2. The ink cartridge of claim 1 wherein the flow path comprises a channel on the exterior surface of the first panel portion of the body portion, the channel having a first end and a second end, the first end including an aperture extending between the interior and exterior surfaces of the first panel portion, and a substantially liquid and gas impermeable cover positioned over all portions of the channel except a terminal portion adjacent the second end of the channel.

3. The ink cartridge of claim 1 wherein the flow path is substantially serpentine.

4. The ink cartridge of claim 1 wherein the flow path is substantially straight.

5. The ink cartridge of claim 1 wherein the flow path has a cross-sectional area ranging from about 0.1 to about 2.0 mm.

6. The ink cartridge of claim 1 wherein the ratio of flow path length to flow path cross-sectional area ranges from about 20 mm$^{-1}$ to about 6000 mm$^{-1}$.

7. An ink cartridge for an ink jet printer, the cartridge comprising a body portion including a first panel portion having an interior surface opposite an exterior surface exposed to an atmosphere having an atmospheric pressure, a second panel portion attachable to the body portion to define a cavity for containing ink between the first and second panel portions, a chamber defined within the cavity adjacent the interior surface of the first panel portion of the body portion, a water vapor permeable lung type pressure regulator disposed within the cavity adjacent the chamber, and a vent system for air flow communication between the chamber and the atmosphere, the vent system comprising an elongate flow path defined on the first panel portion of the body portion, the flow path comprising a channel on the exterior surface of the first panel portion of the body portion, the channel having a first end and a second end, the first end including an aperture extending between the interior and exterior surface of the first panel portion, and a substantially liquid and vapor impermeable cover positioned over all portions of the channel except a terminal portion adjacent the second end of the channel, whereby the flowpath enables air flow communication between the chamber and the atmosphere while substantially inhibiting flow of water vapor out of the chamber.

8. The ink cartridge of claim 7 wherein the flow path is substantially straight.

9. The ink cartridge of claim 7 wherein the flow path is substantially serpentine.

10. The ink cartridge of claim 7 wherein the flow path has a cross-sectional area ranging from about 0.1 to about 2.0 $mm^2$.

11. The ink cartridge of claim 7 wherein the ratio of flow path length to flow path cross-sectional area ranges from about 20 $mm^{-1}$ to about 6000 $mm^{-1}$.

12. In ink jet pen having an exterior portion and an interior portion, and a pressure regulator within the interior portion including a chamber associated therewith, the improvement comprising a vent system provided by an elongate air flow path defined on an exterior surface of the pen, the flow path having a first end in flow communication with the chamber of the internal pressure regulator and a second end in flow communication with the exterior surface of the pen, the vent system being configured to substantially inhibit water vapor flow to the exterior of the pen from the chamber of the pressure regulator.

13. The vent system of claim 12, wherein the flow path comprises a channel on the exterior of the pen, the channel having a first end and a second end, the first end including an aperture extending between the exterior of the pen and the chamber, and a substantially liquid and vapor impermeable cover positioned over all portions the channel except a terminal portion adjacent the second end of the channel.

14. The vent system of claim 12, wherein the flow path is substantially serpentine.

15. The vent system of claim 12 wherein the flow path is substantially straight.

16. The vent system of claim 12 wherein the flow path has a cross-sectional area ranging from about 0.1 to about 2.0 $mm^2$.

17. The vent system claim 12 wherein the ratio of flow path length to flow path cross-sectional area ranges from about 20 $mm^{-1}$ to about 6000 $mm^{-1}$.

18. The vent system of claim 13, wherein the cover comprises a flexible sheet material.

* * * * *